US005152485A

United States Patent [19]

Follick

[11] Patent Number: 5,152,485

[45] Date of Patent: Oct. 6, 1992

[54] COLLAPSABLE SIGN SUPPORT

[76] Inventor: George E. Follick, P.O. Box 15207, Wyoming, Ohio 45215

[21] Appl. No.: 682,444

[22] Filed: Apr. 8, 1991

[51] Int. Cl.[5] ..... F16M 13/00

[52] U.S. Cl. ..... 248/166; 248/170

[58] Field of Search ..... 248/166, 165, 163.1, 248/170, 434, 436

[56] References Cited

U.S. PATENT DOCUMENTS

| | | | |
|---|---|---|---|
| 2,991,034 | 7/1961 | Lyon | 248/170 |
| 4,691,892 | 9/1987 | Grewe | 248/170 |
| 4,988,064 | 1/1991 | Hoshino | 248/170 |

OTHER PUBLICATIONS

Eastern Metal of Elmira, Inc., Elmira, N.Y.,-Catalog of signs & safety equipment.

*Primary Examiner*—Robert W. Gibson, Jr.
*Attorney, Agent, or Firm*—Frost & Jacobs

[57] ABSTRACT

The present invention relates to a collapsable frame for a sign, for example, those used in road construction and repair. The sign frame is adapted to be unfolded from a collapsed position to a display position with releasable locking means to hold the frame in the display position. The present invention also comprises optional releasable resilient locking means, such as a spring, to hold the frame in the display position while allowing it to give slightly in wind and weather.

8 Claims, 6 Drawing Sheets

COLLAPSABLE SIGN SUPPORT

INTRODUCTION

The present invention relates a collapsable sign support frame.

Collapsable sign support frames are used in a wide variety of interior and exterior applications, particularly where temporary or short term use and/or positional change of the sign is desired.

Such signs find exterior application for example in road and highway construction repair. Signs of this type must be large enough to be seen by motorists (generally on the order of four to six feet across) and yet sufficiently heavy, well constructed and stabilized to withstand wind and weather and other forces that might otherwise topple them. Some of the problems related to the large size and weight of support for highway signs include difficulty in handling, transportation and storage. Sign supports of this general type and size are typically of metal construction and can be heavy, cumbersome and difficult to efficiently organize and package for storage and transport.

With respect to wind and weather resistance, highway sign supports have been subject to toppling owing to their broad wind profile. One method of diminishing this profile has been to cut flapped holes in the sign to allow the through-flow of air. However, this method has the drawbacks of affecting the readability and diminishing the overall reflective surface of the sign. Also, such wind slits are always a deterrent to visibility even when they are of no benefit during mild weather. Thus, it is desirable to be able to construct such signs so that they can be optionally set either resiliently against wind and weather or rigidly when the environment allows, without the disadvantages of prior art techniques.

The necessarily large size of highway signs and other large display signs makes their supports difficult to handle, store and transport. In this regard, space is a premium when the sign supports are transported by truck or handcart. Thus, it is desirable to be able to construct a collapsable sign support which can be rendered to a sufficiently small size for easy transport, and for easy carrying and set-up by hand.

These and other objectives are accomplished by the present invention. Other advantages will be apparent to those experienced in the art in light of the present disclosure.

SUMMARY OF THE INVENTION

Toward obtaining the above-described advantages and eliminating problems attendant to the prior art, the present invention provides for a collapsable sign support comprising (a) a lower support frame portion, (b) leg means adapted to maintain the lower support frame portion in a swingable, substantially vertical position, (c) an upper support frame portion which is smaller than the lower support frame portion and which is movably attached at the top of the lower support frame portion so as to be movable from a first position (collapsed) which is substantially within the space defined by the lower support frame portion, to a second position (the display position) extensive of the lower support frame portion; (d) means to releasably lock the upper support frame portion in the second (display) position and (e) means to attach a sign or other indicia-bearing member to at least one of the support frame portions while in the second (display) position.

As used herein with respect to the upper and lower support frame portions, the terms "top" and "bottom" are intended as relative terms to refer to relative regions respectively above and below the center lines of the upper and lower support frame portions.

The geometric configuration of the upper and lower support frame portions is not a limitation. That is, these portions may have nearly any shape with the only requirement being that the upper support frame portion be of such a size so as to fit within the space defined by the dimensions of the lower support frame portion.

With respect to the attachment between the upper and lower support frame portions, the present invention contemplates any such movable attachments, such as any hinge means, etc., with the only requirement being that the upper support frame portion be movable between the first (collapsed) position and the second (display) position as described herein.

The means for releasably locking the upper support frame portion in the second (display) position may be any mechanical means equivalent to the means used in the preferred embodiment described herein below. Such equivalent means may be any kind of hook, magnet, bolt, spring, etc. The invention may also preferably include additional alternative releasably locking means to springably lock the upper support frame in the second (display) position. In this regard, it is preferred that the second (display) position is both extensive of and substantially parallel to the lower support frame portion.

The preferred shape of the upper and lower support frame portions is to represent three sides of a rectangle, as this is thought to provide the best combination between ease of manufacture and physical support for the sign member.

It is also preferred that the present invention incorporate mechanical means of any sort such as for instance a spring, to releasably lock the upper support frame portion into the first (collapsed) position as well.

DESCRIPTION OF THE DRAWINGS

The following figures show a single, preferred embodiment of a sign support in accordance with the present invention.

DETAILED DESCRIPTION OF THE PREFERRED EMBODIMENTS

A preferred embodiment of the present invention is shown in the attached drawings. It is also the best mode known of the invention.

Figure 1:
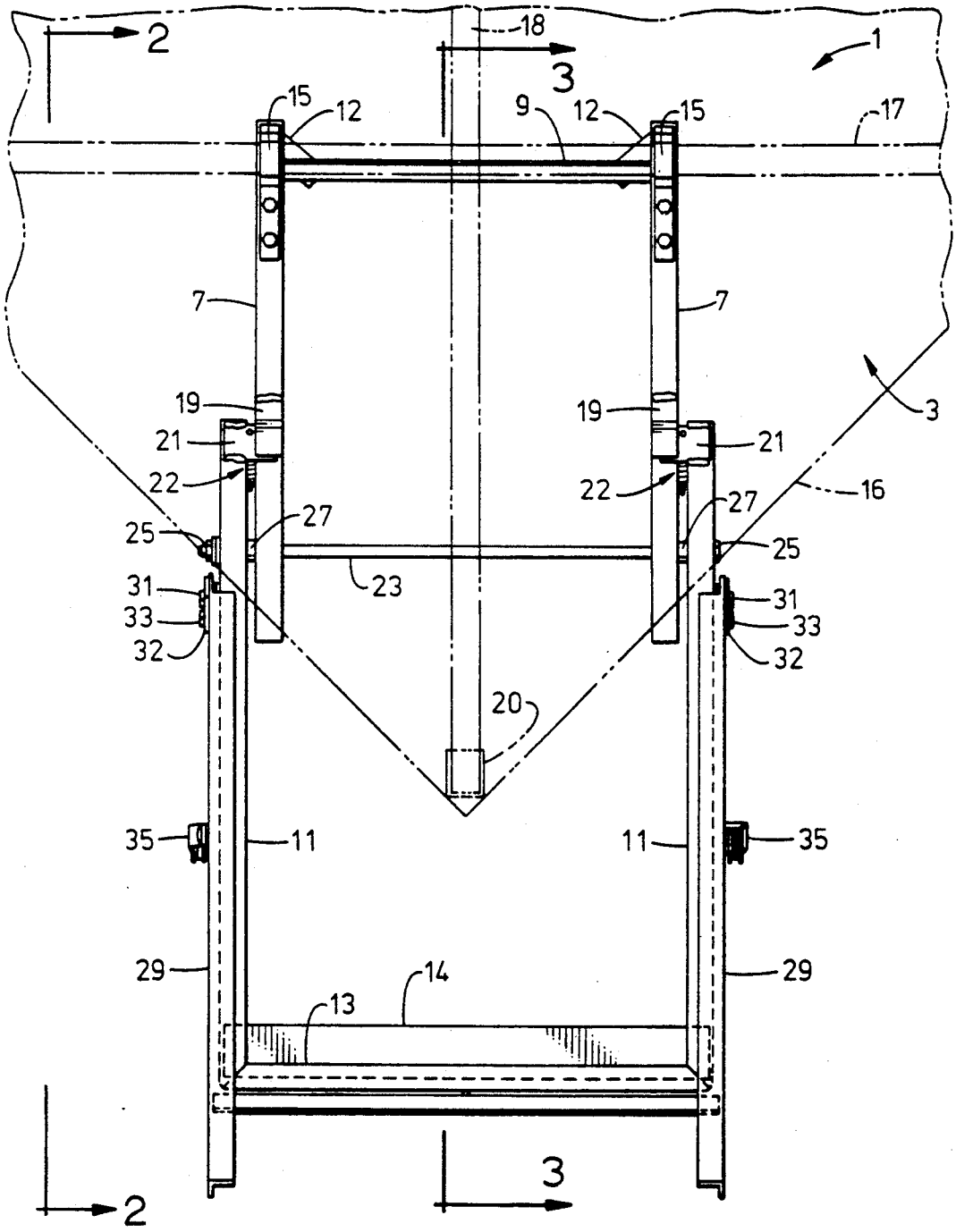
FIG. 1 is a facing view of the opened sign support with a roll-up sign attached thereto.

FIG. 1 shows a facing view of the sign support 1 holding a foldable sign 16 in a display position. The sign support 1 comprises an upper support frame portion 3 and a lower support frame portion 5. The upper support frame portion 3 comprises two vertical members 7 and a horizontal member 9 so as to form three sides of a rectangle facing downward when the sign support 1 is in the open display position. The upper support frame portion 3 also has attached to it, on the vertical members 7, two holding clips 15 which are adapted to hold the cross member 17 of the sign 16. Rod holders 12 are used for optionally attaching a sign which is held by rods of wood and the like. This feature is seen in more detail in the latter figures. The upper support frame portion 3 also has affixed to it two tang clips 19 which are adapted to engage tangs 21 attached to the top of the lower support frame portion 5, comprising vertical members 11 and horizontal member 13, which together form a rectangle open at the top. As can be appreciated from FIG. 1, the upper support frame portion 3 is slightly smaller than lower support frame portion 5 so as to allow the upper support frame portion 3 to nest within the lower support frame portion 5 when it is rotated downward into the closed position as will be described in more detail below. The lower support frame portion is also heavier to maintain the center of gravity of the two support portions, when engaged in the shown display position, below the rotation point (i.e. cross rod 23). Near the top of the upper support frame portion 5 is attached cross rod 23 which extends through to bridge vertical members 11 and which is held in place by cross rod nuts 25, the ends of cross rod 23 being appropriately threaded. Cross rod 23 also extends through a vertical slot cut in vertical members 7 which allows the upper support frame portion 3 to be lifted up and lowered down again so that tang clips 19 may engage respective tangs 21. This is shown in more detail in the other figures. Space sleeves 27, somewhat greater in diameter than the holes in vertical members 7 and 11 through which cross rod 23 passes, maintain spacing between the upper and lower support frame portions so that the upper support frame portion 3 remains centered in lower support frame portion 5 when moved between an open and closed position. Also attached to lower support frame portion 5 is a through-swing blocking member 14 which serves to increase the effective width of horizontal member 13 so as to prevent upper support frame portion 3 from swinging completely freely through the lower support frame portion so that it will come to rest in a nested position in the lower support frame portion 5.

Also attached to the lower support frame portion are foldable legs 29 which are attached by main leg bolts 31, off-set piece 32 and off-set leg bolts 33, whose arrangement is more clearly appreciated from the later drawings. Foldable legs 29 are also supported once opened by leg cross-braces 35, more clearly appreciated from the latter figures.

The sign 16 may contain any arrangement of indicia (not shown). The sign shown in this embodiment is a reflective polymeric sheet material which is held in an open display position by horizontal cross-member 17 and vertical cross-member 18. The ends of these cross-members are held to the foldable sign with the aid of a plastic mating pocket 20 bolted thereto.

Figure 2:
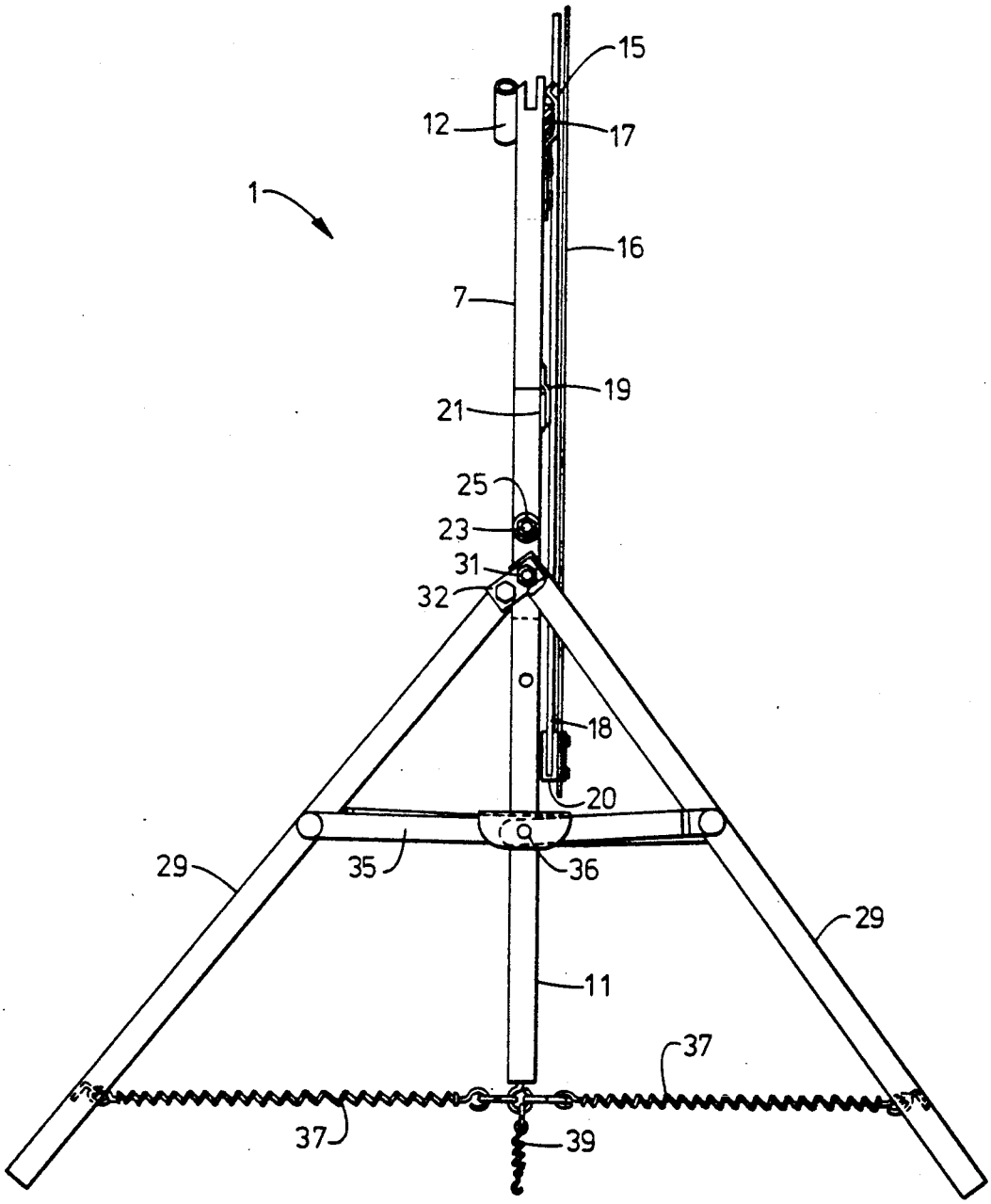
FIG. 2 is a lateral view of the opened sign support.

FIG. 2 shows a side view of the sign support 1 in its opened display position. Many of the features discussed above are more clearly visible such as the horizontal sign cross-member 17 which fits into clip 15 and the mating pocket 20 which together serve to hold the sign 16 in an open position. Also shown is the engagement of the tang clip 19 with tang 21 which holds upper support frame portion 7 substantially parallel to lower support frame portion 11. FIG. 2 also shows the position of cross rod 23 held in position by cross rod nut 25. Also seen in FIG. 2 is the arrangement of the legs 29 and how they are attached to vertical member 11. One leg and an off-set piece 32 are bolted to vertical member 11 by main leg bolt 31 while the other leg is bolted to off-set member 32 by off-set leg bolt 33. Leg cross-brace 35 bridges legs 29 and a hinge point in 36 in the center of cross-brace 35 allows the brace to be folded as legs 29 are folded into the vertical position. Leg springs 37 also serve to stabilize the legs in the open position. Closure spring 39 is shown here unengaged and engages the horizontal member 9 of the upper support frame portion to hold the support frame in the closed configuration.

Figure 3:
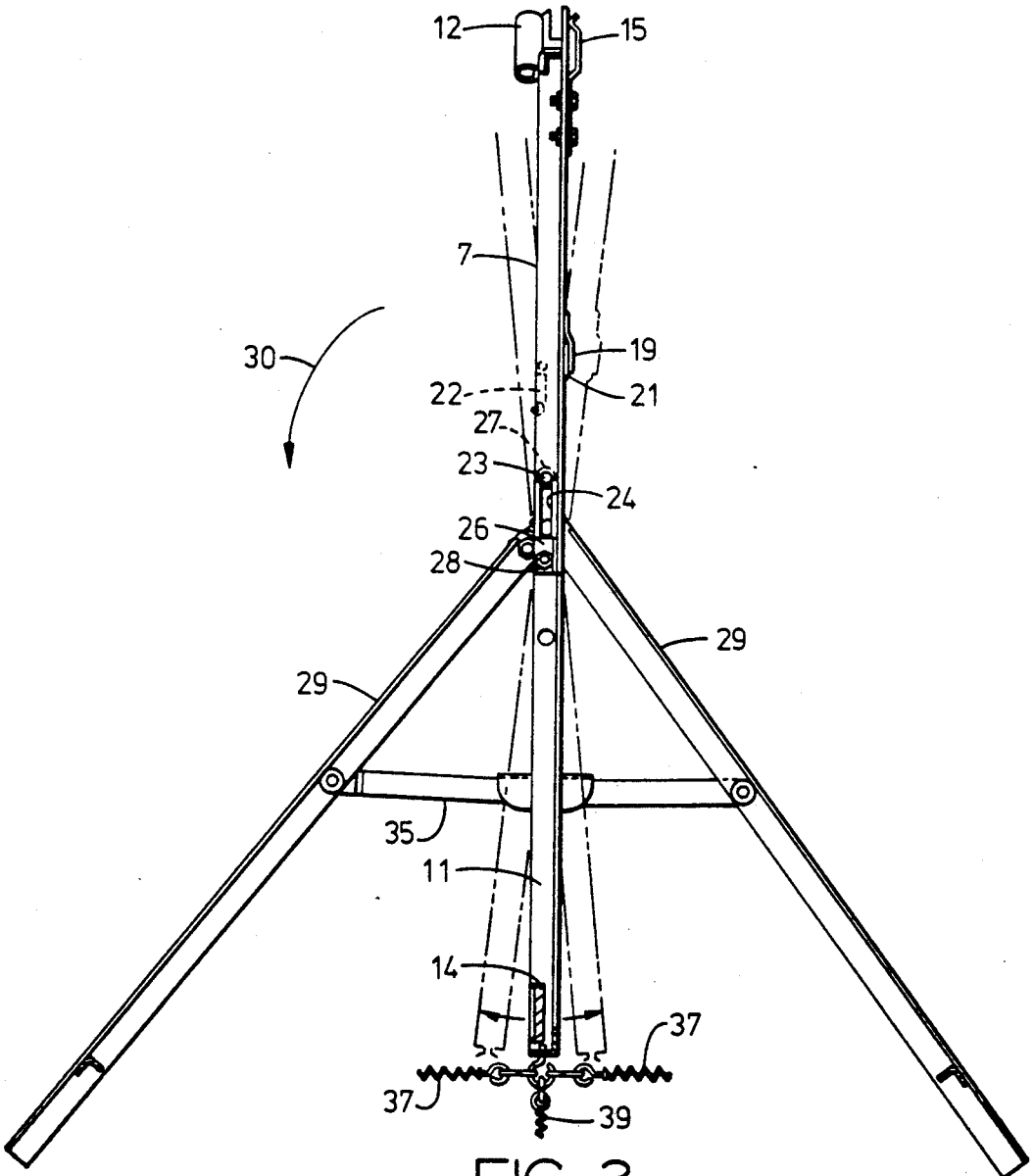
FIG. 3 is a lateral view sectioned along line 3—3 of FIG. 1.

FIG. 3 shows many of the same features of FIGS. 1 and 2 but is a cross-section along lines 3—3 of FIG. 1. This view more clearly shows the way in which cross-rod 23 fits into slot 24 in both vertical members 7 (only one slot shown) whereby the upper support frame portion 7 may be lifted a short distance vertically so as to disengage tang clip 19 from tang 21 and then to allow upper support frame portion 7 to rotate downward, about cross rod 23, as shown by direction arrow 30 to a position nested within lower support frame portion 5. Also seen in FIG. 3 is slot chock piece 26 which is bolted, by slot chock piece bolt 28, to vertical member 7 so as to close the end of the slot 24.

FIGS. 2 and 3 also show the position of rod holders 12, a pair of which are are mounted on the top of the upper support frame portion 3 to provide holding means for foldable signs which are mounted on wooden rods and the like.

Figures 4, 5:
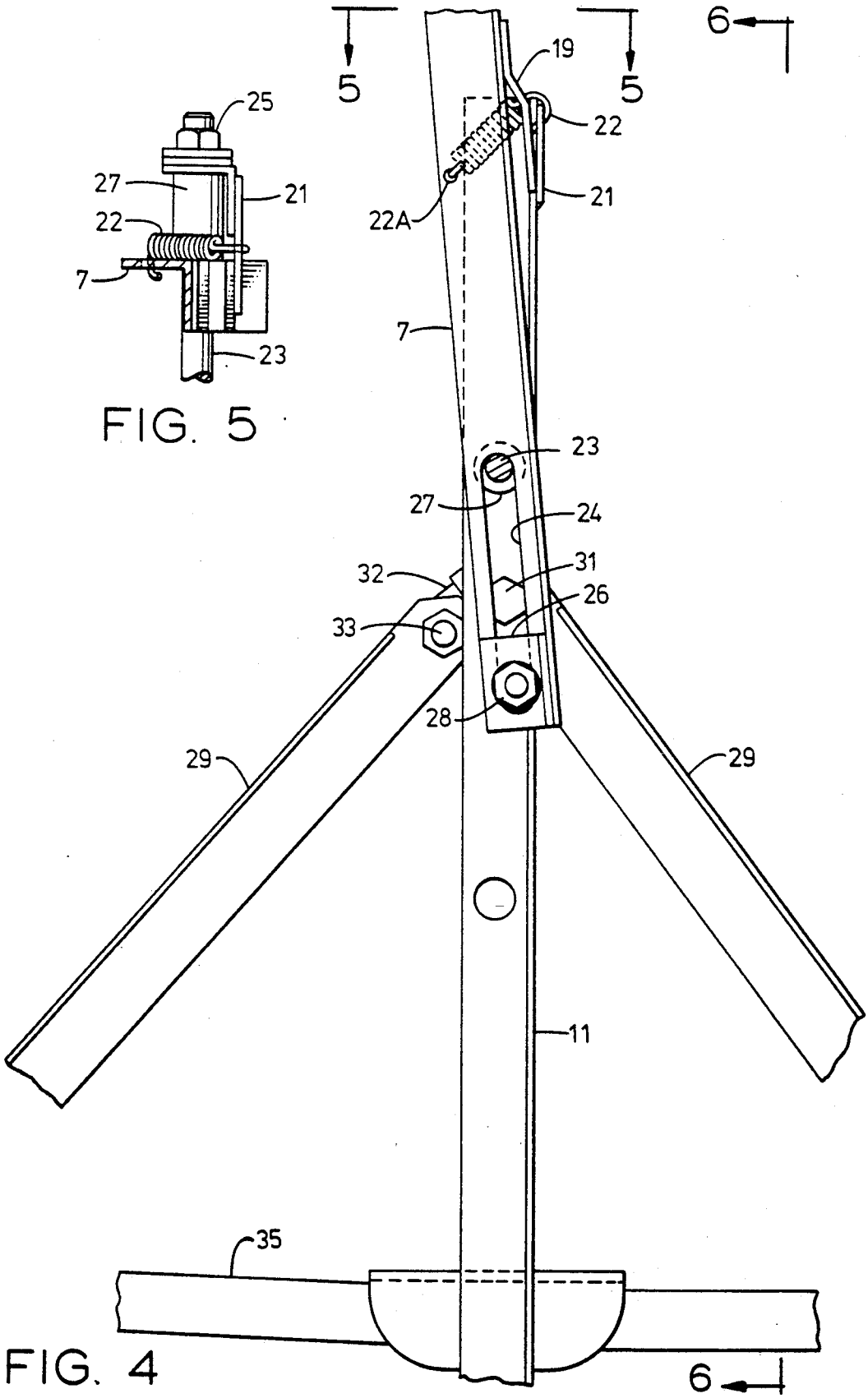
FIG. 4 is a detailed lateral view showing the folding mechanism of the sign support.
FIG. 5 is a detailed overhead view sectioned along line 5—5 of FIG. 4 and showing the locking mechanism in detail.

FIG. 4 shows a more detailed view of the mechanical folding arrangement shown in FIG. 3. This view also shows an alternative, more preferred embodiment whereby a spring means, for instance such as spring 22, may be attached to one or both of vertical members 7 (via holes 22A; only one shown) so as to be capable of releasably engaging tang 21 without the engagement of tang clip 19. Such an arrangement allows upper support frame portion 3 to be maintained substantially in the same plane as lower support frame portion 5 without being rigidly engaged in this position. This allows the sign support to be more resilient in the face of wind and weather by both rotation about cross rod 23 and by upper support frame portion being able to move slightly with respect to the lower support frame portion, while automatically righting itself to maintain the visibility and reflectivity of the sign attached thereto.

FIG. 5 is an overhead section view along line 5—5 which shows, in much more detailed fashion, the positioning of the cross-rod 23, its securing nut 25 and the spacer sleeve 27. Also shown is the spring 22 in engagement with both vertical member 7 and tang 21. The spring 22 may be attached in such a way as to be permanently attached to vertical member 7 and releasable from tang 21, which will allow the spring to fit into the space maintained by spacer 27 when the sign support in the closed position.

Figure 6:
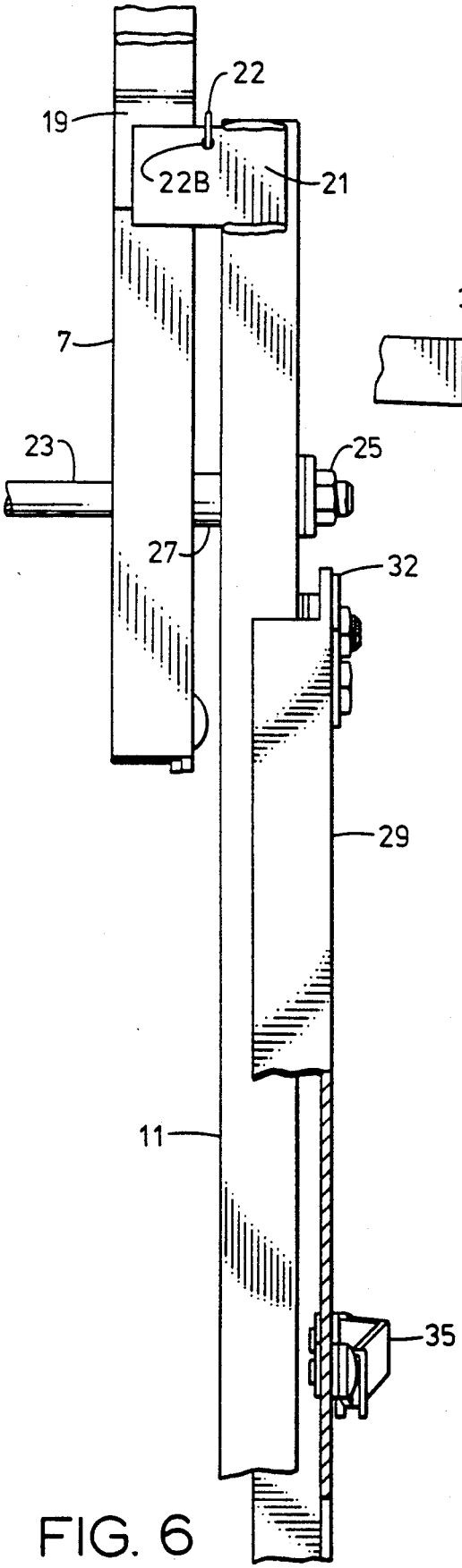
FIG. 6 is a detailed facing view showing the folding and locking mechanism in detail.

FIG. 6 shows a detailed facing view of the sign support in the configuration shown in FIG. 4, with the spring 22 engaged in hole 22B of tang 21, holding vertical member 7 substantially parallel to vertical member 11. As can be seen in FIG. 6, the outer surface of clip 19 simply rests against tang 21 in this position. The tang is slim enough to allow upper support frame portion to be maintained substantially in the same general plane as the lower support frame portion. FIG. 6 also shows more detail regarding the positioning of cross-rod 23, spacer 27 and cross-rod nut 25, with cross-rod 23 being threaded on both ends to accept cross-rod nut 25.

Figure 7:
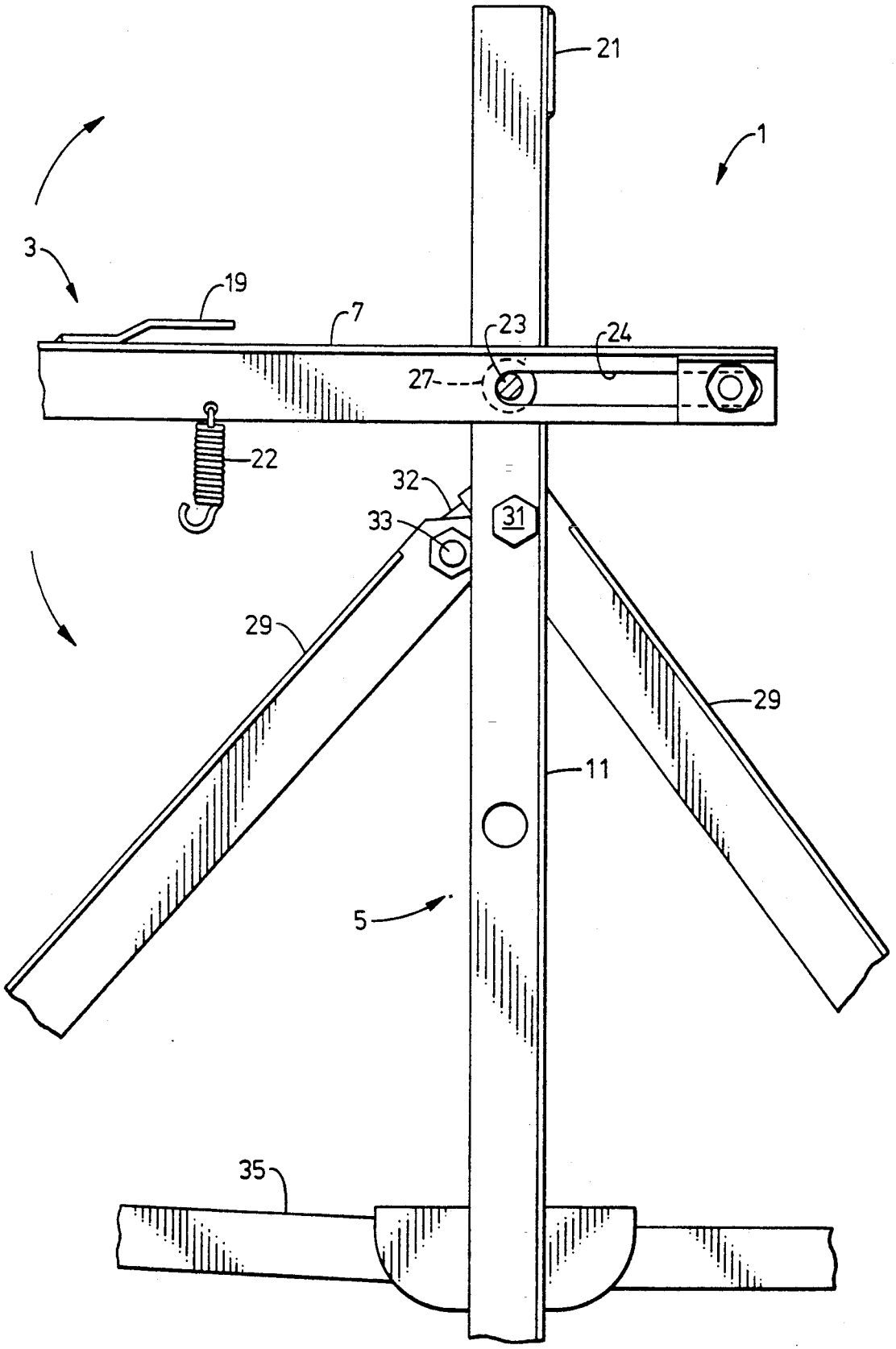
FIG. 7 is a detailed lateral view showing the upper frame support portion as it would appear approximately half way between the collapsed and display positions.

FIG. 7 is intended to show sign support 1 in a dynamic configuration half-way between the opened and closed position as indicated by the directional arrows. This view shows how upper support frame portion 3 may be disengaged (by the release of clip 19 from tang 21 and folded downward as it rotates, by virtue of slot 24 about cross-rod 23 while its position vis-a-vis lower support frame portion 5 is maintained by spacer sleeve 27. Disengaged spring 22 remains permanently attached to vertical member 7 as the sign support is moved to the collapsed position.

Figure 8:
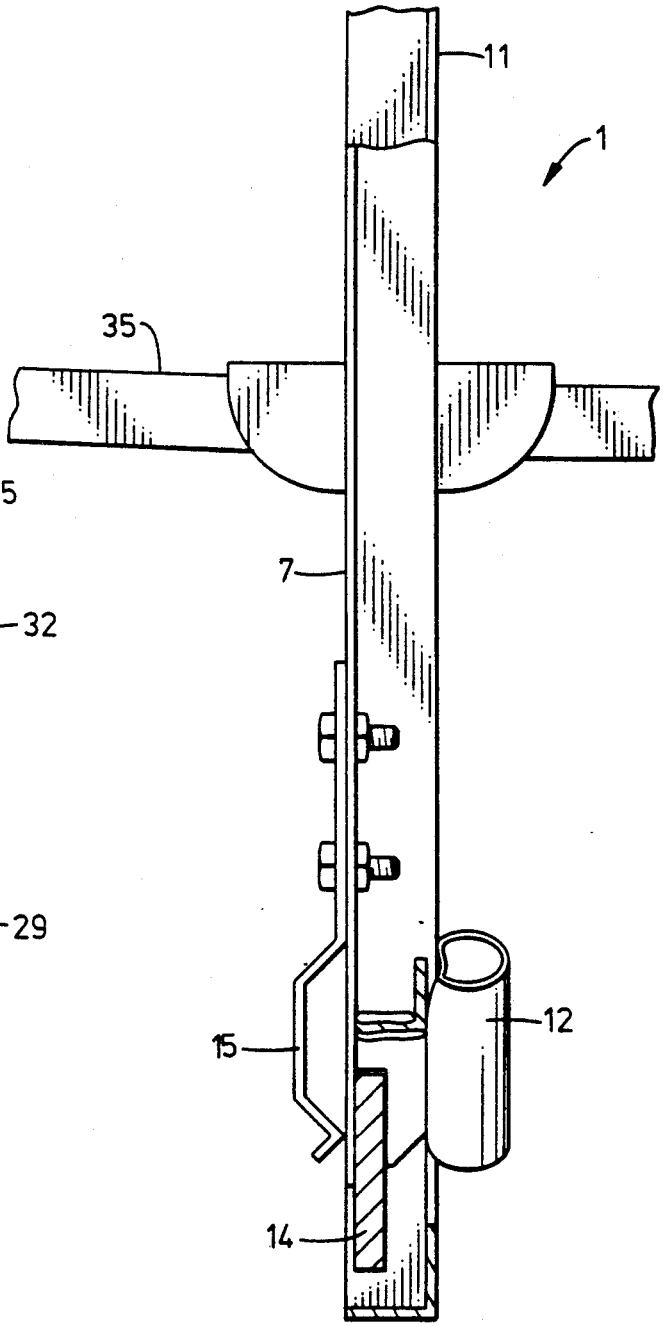
FIG. 8 is a detailed lateral view of the upper and lower support frame portions resting in a collapsed position.

FIG. 8 is a detailed view showing a cross-section of the bottom of the sign support 1 as it would appear with upper support frame portion 3 nested within lower support frame portion 5 while the legs are still unfolded as indicated by the position of leg cross brace 35. This view shows how, on each side, vertical member 7 fits within vertical member 11, and how upper support frame portion 3 is kept from swinging freely by through-swing blocking member 14. Upper support frame portion 3 may be held against through-swing blocking member 14 by engaging closure spring 39 by hooking it to horizontal member 13 so as to maintain upper support frame portion 3 abutting against through-swing blocking member 14 when in the closed position.

The sign support of the present invention may be constructed of any material appropriate to the individual application. Such materials may include metal (preferably resistant to rust for exterior applications), plastics, wood, etc. In the displayed embodiment of FIGS. 1–8, the materials used include right-angled steel, metal springs and metal bolts. Where not otherwise bolted, individual pieces may be attached by spot-welding or other techniques which would be appropriate to the particular constructing material (i.e. wood, plastic, metal), and which are known in the art.

In light of the foregoing disclosure, it will be obvious to one of ordinary skill in the art to make alterations and modifications to the invention, such as by the use of equivalent materials and mechanical arrangements, without departing from the invention's spirit and the literal and equivalent scope of the following claims.

What is claimed is:

1. A collapsable sign support comprising:

(a) a lower support frame portion having a top and a bottom;

(b) leg means adapted to maintain said lower support frame portion in a swingable, substantially vertical position, said lower support frame portion having dimensions defining a space;

(c) an upper support frame portion smaller than said lower support frame portion, movably attached near the top of said lower support frame portion so as to be movable between a first position substantially within said defined space to a second position extensive of said lower support frame portion;

(d) means to retain said upper support frame portion in said second position further comprising means for resiliently attaching said upper support frame portion while in said second position to said lower support frame portion such that said upper support frame can rotate, within a limited travel, about a horizontal axis positioned at the attachment of said upper support frame portion to said lower support frame portion; and (e) means to attach an indicia-bearing member to at least one of said support frame portions while in said second position.

2. A collapsable sign support according to claim 1 wherein said second position is extensive of and substantially parallel to said lower support frame portion.

3. A collapsable sign support according to claim 1 additionally comprising means to releasably lock said upper support frame portion in said first position.

4. A collapsable sign support comprising:

(a) a lower support frame portion having a top and a bottom, said lower support frame portion comprising two vertical side members and a horizontal end member, said members defining three sides of a first rectangle open at the top;

(b) leg means adapted to maintain said lower support frame portion in a swingable, substantially vertical position, said leg means comprising folding legs attached at the top of said vertical side members;

(c) an upper support frame portion, said upper support frame portion comprising two vertical members and a horizontal member, said members defining three sides of a second rectangle smaller than said first rectangle and open at the bottom, attached at the top of said lower support frame portion so as to be movable from a first position substantially within said defined space to a second position extensive of said lower support frame portion; and (d) means to releasably lock said upper support frame portion in said second position; said means to releasably lock said upper support frame portion comprising, on the top of at least one of said vertical members of said lower support frame portion, a tang and, on at least one of said vertical members of said upper support frame, a mating clip adapted to engage said tang so as to releasably lock said upper support frame portion substantially in the plane of said first rectangle.

5. A collapsable sign support according to claim 4 additionally comprising a releasable spring adapted to engage said top of said lower support frame portion and the bottom of said upper support portion in such a position that, when engaged, said spring urges said upper support frame portion toward a position substantially parallel to the plane of said first rectangle.

6. A collapsable sign support according to claim 4 additionally comprising a releasable spring adapted to engage said bottom of said lower support frame portion and the top of said upper support frame portion in such a position that, when engaged, said spring urges said upper support frame portion toward said position.

7. A collapsable sign support according to claim 1, further comprising means for releasing said upper support frame portion while in said second position from said lower support frame portion, thereby allowing said upper support frame portion to be returned to said first position.

8. A collapsable sign support according to claim 1, wherein said means for resiliently attaching said upper support frame portion while in said second position to said lower support frame portion comprises a coil spring.

* * * * *